US007316543B2

(12) United States Patent
Goodson et al.

(10) Patent No.: US 7,316,543 B2
(45) Date of Patent: Jan. 8, 2008

(54) ELECTROOSMOTIC MICROPUMP WITH PLANAR FEATURES

(75) Inventors: Kenneth E. Goodson, Belmont, CA (US); Thomas W. Kenny, San Carlos, CA (US); Juan G. Santiago, Freemont, CA (US); Daniel J. Laser, San Francisco, CA (US); Chuan-Hua Chen, Stanford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 142 days.

(21) Appl. No.: 10/449,564

(22) Filed: May 30, 2003

(65) Prior Publication Data

US 2004/0241004 A1 Dec. 2, 2004

(51) Int. Cl.

| | |
|---|---|
| ***H02K 44/00*** | (2006.01) |
| *H02K 44/08* | (2006.01) |
| *F04B 37/02* | (2006.01) |
| *F04F 11/00* | (2006.01) |

(52) U.S. Cl. ..... 417/50; 417/48; 204/454; 204/600

(58) Field of Classification Search ..... 417/48, 417/50; 204/600, 454

See application file for complete search history.

(56) References Cited

U.S. PATENT DOCUMENTS

| | | | | |
|---|---|---|---|---|
| 3,923,426 | A | 12/1975 | Theeuwes | 417/48 |
| 4,908,112 | A | 3/1990 | Pace | 204/299 |
| 5,096,388 | A | 3/1992 | Weinberg | 417/322 |
| 5,219,278 | A | 6/1993 | Van Lintel | 417/413 |
| 5,336,062 | A | 8/1994 | Richter | 417/413 |
| 5,759,014 | A | 6/1998 | Van Lintel | 417/413.3 |
| 5,763,951 | A | 6/1998 | Hamilton et al. | 257/714 |
| 5,836,750 | A | 11/1998 | Cabuz | 417/322 |
| 5,858,188 | A | 1/1999 | Soane et al. | 204/454 |
| 5,880,071 | A | 3/1999 | Parce et al. | 204/453 |
| 5,942,093 | A | 8/1999 | Rakestraw et al. | 204/450 |
| 5,965,001 | A | 10/1999 | Chow et al. | 204/600 |
| 6,007,309 | A | 12/1999 | Hartley | 417/322 |
| 6,010,316 | A | 1/2000 | Haller et al. | 417/322 |
| 6,013,164 | A | 1/2000 | Paul et al. | 204/450 |
| 6,019,882 | A | 2/2000 | Paul et al. | 204/450 |
| 6,054,034 | A | 4/2000 | Soane et al. | 204/601 |

(Continued)

OTHER PUBLICATIONS

Laser, et al., High Frequency Actuation with Silicon Electroosmotic Micropumps, paper presented at 2002 Solid State Sensors and Actuators and Microsystems Workshop, Jun. 2002, Hilton Head, S.C.

(Continued)

*Primary Examiner*—Anthony D. Stashick
(74) *Attorney, Agent, or Firm*—Womble Carlyle Sandridge & Rice, PLLC

(57) ABSTRACT

An electroosmotic micropump having a plurality of thin, closely-spaced, approximately planar, transversel aligned partitions formed in or on a substrate, among which electroosmotic flow (EOF) is generated. Electrodes are located within enclosed inlet and outlet manifolds on either side of the partition array. Inlet and outlet ports enable fluid to be pumped into and through the micropump and through an external friction load or head. Insulating layer coatings on the formed substrate limit substrate leakage current during pumping operation.

37 Claims, 17 Drawing Sheets

U.S. PATENT DOCUMENTS

| | | | | |
|---|---|---|---|---|
| 6,068,752 | A | 5/2000 | Dubrow et al. | 204/604 |
| 6,090,251 | A | 7/2000 | Sundberg et al. | 204/453 |
| 6,100,541 | A | 8/2000 | Nagle et al. | 250/573 |
| 6,146,103 | A | 11/2000 | Lee et al. | 417/50 |
| 6,171,067 | B1 * | 1/2001 | Parce | 417/48 |
| 6,174,675 | B1 | 1/2001 | Chow et al. | 435/6 |
| 6,186,660 | B1 | 2/2001 | Kopf-Sill et al. | 366/340 |
| 6,210,986 | B1 | 4/2001 | Arnold et al. | 438/42 |
| 6,221,226 | B1 | 4/2001 | Kopf-Sill | 204/602 |
| 6,227,809 | B1 | 5/2001 | Forster et al. | 417/53 |
| 6,238,538 | B1 | 5/2001 | Parce et al. | 204/600 |
| 6,277,257 | B1 | 8/2001 | Paul et al. | 204/450 |
| 6,287,440 | B1 | 9/2001 | Arnold et al. | 204/80.3 |
| 6,321,791 | B1 | 11/2001 | Chow | 137/833 |
| 6,322,753 | B1 | 11/2001 | Lindberg et al. | 422/192 |
| 6,576,478 | B1 * | 6/2003 | Wagner et al. | 436/518 |
| 6,619,925 | B2 * | 9/2003 | Ohkawa | 417/48 |
| 6,770,183 | B1 * | 8/2004 | Hencken et al. | 204/600 |
| 2001/0044155 | A1 | 11/2001 | Paul et al. | 436/161 |
| 2001/0046703 | A1 | 11/2001 | Burns et al. | 435/303.1 |
| 2003/0127329 | A1 * | 7/2003 | DeVoe et al. | 204/454 |
| 2004/0120827 | A1 * | 6/2004 | Kim et al. | 417/48 |
| 2004/0208751 | A1 * | 10/2004 | Lazar et al. | 417/48 |
| 2004/0247450 | A1 * | 12/2004 | Kutchinsky et al. | 417/48 |

OTHER PUBLICATIONS

"Modeling of Two-Phase Microchanel Heat Sinks for VLSI Chips," Koo, et al., Proceedings of the IEEE Micro Electro Mechanical Systems (MEMS); 2001; p. 422-426.

"Silicon Micromachining and Micromachines," Esashi, Wear; Sep. 1, 1993; v. 168 No. 1-2, p. 181-187.

"Flow characteristics of water through a microchannel between two parallel plates with electrokinetic effects", Mala et al., International Journal of Heat and Fluid Flow; Oct. 1997; v.18, No. 5, p. 489-496.

"Heat transfer and fluid flow microchannels", Mala et al., International Journal of Heat and Mass Transfer; Sep. 1997; v.40, No. 13, p. 3079-3088.

"Integrated electroosmotic pumps and flow manifolds for total chemical analysis systems", Manz et al., Conference: 1991 International Conference on Solid-State Sensors and Actuators, Jun. 24-28, 1991, San Francisco, CA, USA.

"Electroosmatically induced hydraulic pumping with integrated electrodes on microfluidic devices", McKnight et al., Analytical Chemistry; Aug. 15, 2001; v.73, No. 16, p. 4045-4049.

"Partial electroosmotic pumping in complex capillary systems. Part 1: Principles and general theoretical approach", Morf et al., Sensors and Actuators, B: Chemical; Feb. 2001; v.72, No. 3, p. 266-272.

"Flow rate measurement via conductivity monitoring in microfluidic devices", Rainey et al., Proceedings of SPIE—The International Society for Optical Engineering; 2000; v. 4177, p. 185-193.

"Acousto-and electroosmotic microfluidic controllers", Rife et al., Proceedings of SPIE—The International Society for Optical Engineering; 1998; v.3515, p. 125-135.

"Liquid flow and heat transfer in microchannels: A review", Rostami et al., Heat and Technology; 2000; v.18, No. 2, p. 59-68.

"Electroosmotic pumping and valveless control of fluid flow within a manifold of capillaries on a glass chip", Seiler, et al., Analytical Chemistry; Oct. 15, 1994; v.66, No. 20, p. 3485-3491.

"Microflow devices and systems", Shoji et al., Journal of Micromechanics and Microengineering; Dec. 1994; v.4, No. 4, p. 157-171.

"Electrokinetic dewatering and thickening. I. Introduction and historical review of electrokinetic applications", Sunderland, J Appi Electrochem; Sep. 1987; v.17, No. 5, p. 889-898.

"Modeling forced liquid convection in rectangular microchannels with electrokinetic effects", Yang et al., International Journal of Heat and Mass Transfer; Dec. 1998; v.41, No. 24, p. 4229-4249.

"Fabrication, Derivatization and Applications of Plastic Microfluidic Devices", Barker, et al., Proceedings of SPIE—The International Society for Optical Engineering, Nov. 2000, v.4205, p. 112-118.

"Fabrication and characterization of electrokinetic micro pumps", Zeng et al., Thermomechanical Phenomena in Electronic Systems -Proceedings of the Intersociety Conference; 2000; v.2, p. 31-36.

"Partial electroosmotic pumping in complex capillary systems. Part 2: Fabrication and application of a micro total analysis system suited for continuous volumetric nanotitrations", Guenat et al., Sensors and Actuators, B: Chemical; Feb. 2001; v.72, No. 3, p. 273-282.

"Electroosmotic pumping within a chemical sensor system integrated on silicon", Harrison et al., Conference: 1991 International Conference on Solid-State Sensors and Actuators, Jun. 24-28, 1991 San Francisco, CA, USA.

"Electroosniotic flow control in micro channels produced by scanning excimer laser ablation", Wagner et at, Proceedings of SPIE—The International Society for Optical Engineering; 2000; v.4088, p. 337-340.

"Liquid transport in rectangular microchannels by electroosmotic pumping", Arulanandam et al., Colloids and Surfaces A: Physicochemical and Engineering Aspects; 2000; v.161, No. 1, p. 89-102.

"Microflow devices for miniaturized chemical analysis systems", Buettgenbach et al., Proceedings of SPIE—The International Society for Optical Engineering; 1998; v.3539, p. 51-61.

"Electroosmosis: A reliable fluid propulsion system for flow injection analysis", Dasgupta et al., Analytical Chemistry; Jun. 1, 1994; v.66, No. 11, p. 1792-1798.

"Closed-Loop Electroosmotic Microchannel Cooling System for VLSI Circuits", Jiang, et al., printed in Journal of MEMS, Jan. 2002.

"Liquid Flows in Microchannels", Sharp, et al., CRC Press, 2002, Chapter 6, p. 6-1 to 6-38.

"Fabrication and characterization of electrokinetic micro pumps", Zeng, et al., 2000 Inter Society Conference on Thermal Phenomena, May 2000, p. 31-35.

"Electrokinetic Generation of High Pressures Using Porous Microstructures", Paul, et at., Micro-total analysis systems, 1998, Banff, Canada 1998, p. 49-52.

"Active control of electroosmotic flow in microchannels using light", Moorthy et al., Sensors and Actuators, B: Chemical; May 15, 2001; v.75, No. 3, p. 223-229.

"Irrotationally of uniform electroosmosis", Cummings et al., Proceedings of SPIE—International Society for Optical Engineering; 1999; v.3877, p. 180-189.

"Electroosmotic pumping and electrophoretic separations for miniaturized chemical analysis systems", Manz. et al., j. Micromech. Microeng., 1994, p. 257-265.

Chen, et al., "Development of a Planar Electrokinetic Micropump," presented at ASME International Mechanical Engineering Congress and Exposition, Orlando, Florida, Nov. 7, 2000.

* cited by examiner

ELECTROOSMOTIC MICROPUMP WITH PLANAR FEATURES

STATEMENT REGARDING FEDERALLY SPONSORED RESEARCH OR DEVELOPMENT

The invention described herein was supported in part by the DARPA HERETIC program, Air Force Contract F33615-99-C-1442.

BACKGROUND OF THE INVENTION

This invention relates generally to non-mechanical micropumps, and more particularly, to electroosmotic micropumps fabricated using microfabrication techniques.

Various types of micropumps have been fabricated using microfabrication techniques. Micropumps can be classified into two categories: mechanical and non-mechanical. Mechanical micropumps such as electrostatically driven reciprocating pumps and thermopneumatically driven peristaltic pumps, contain moving pumps which are of serious concern for long-term reliability. Some of the non-mechanical micropumps, such as electrohydrodynamic micropumps and magnetohydrodynamic, micropumps cannot pump deionized (DI) water due to their fundamental working principles. As a result, these types of non-mechanical micropumps have limited use in medical and biological applications.

A newer type of non-mechanical pump is the electrokinetic (EK) or electroosmotic (EO) pump, which uses electroosmotic flow in a porous media to generate pressures in excess of ten atmospheres (atm). The pressure capacity of EO pumps far exceeds the capacity of other types of micropumps. Electroosmotic pumps have the advantage of being compatible with aqueous solutions as the working fluid. This capability is essential for biological and medical applications. A disadvantage of EO pumps is the complexity of integrating porous media, e.g., packed silica particle beds, into microdevices.

Electroosmotic pumps generate fluid flow and pressure through the application of an electrical potential across a stationary, fluid-filled structure. EO pumps are among a family of devices that take advantage of the electric double layer that typically forms at a liquid-solid interface. Structures used for electroosmotic pumping must have pore-like features within a few orders of magnitude of the size of the electric double layer, which is generally less than a micron. Electroosmotic flit pumps produce high pressures and flow rates in high surface-to-volume structures with micron-sized pores. Electroosmotic frit pumps made from sintered glass frits have been reported that generate pressures of 250 kPa and flow rates of 10 mL/min.

There is a need for electroosmotic micropumps having high pressure and flow rate capacity that can be fabricated from planar structures, such as plastic, glass or silicon substrates, particularly where standard microfabrication techniques, such as microlithography and wet etching, can be used in fabrication. Such electroosmotic micropumps can be directly integrated onto microsystems.

SUMMARY OF THE INVENTION

The electroosmotic micropumps of the present invention incorporate one or more planar features. During operation, the electroosmotic micropumps of the present invention generate fluid flow and/or pressure through electroosmosis. The direction of such electroosmosis is approximately parallel to the surface of a planar feature or planar features in the micropump. Electroosmotic micropumps with planar features can be fabricated using standard microelectromechanical systems (MEMS) technology. For electroosmotic micropumps of the present invention fabricated from planar substrates such as glass, plastic, or silicon wafers or slides, the planar features of the micropump can be oriented parallel or perpendicular to the surface of the substrate. In one embodiment, the electroosmotic micropump structure of the present invention includes a plurality of high aspect ratio, slot-shaped openings passing from one side to the other of a block of solid material. When the slots are filled with fluid, electroosmotic flow can be generated through the application of an electric field. The electroosmotic micropump with the multiple slots can be fabricated in a variety of ways and from a variety of materials. High aspect-ratio structures suitable for electroosmotic pumping can be made using micromachining techniques. The slot structure can be manufactured from a silicon substrate such as a single-crystal silicon wafer using photolithography-based microfabrication techniques. Treatment of the silicon substrate is critical to the operation of the electroosmotic micropump.

The electroosmotic micropump of the invention includes a plurality of slots formed (e.g., etched) in a substrate to generate a pumping region, inlet and outlet manifolds on either side of the pumping region to enable fluid to be pumped into and through the micropump, and a cover that is bonded to the substrate to seal the pumping regions and manifolds. An insulating layer coating is applied to the formed substrate to reduce current flow when an electric filed is applied during pumping operation. An additional layer is applied on top of the insulating layer to provide a desired electrochemistry at the liquid-solid interface in the electroosmotic micropump.

The features of the present invention in one aspect include a multiple-slot electroosmotic flow (EOF) pumping region; the use of deep reactive ion-enhanced etching to produce EOF pumping regions with favorable geometries; treatment of a silicon substrate to provide suitable electrical insulation; and additional treatment of the silicon substrate to improve micropump performance.

DESCRIPTION OF DRAWINGS

The invention is better understood by reading the following detailed description of the invention in conjunction with the accompanying drawings, wherein.

DETAILED DESCRIPTION OF THE INVENTION

The following description of the invention is provided as an enabling teaching of the invention in its best, currently known embodiment. Those skilled in the relevant art will recognize that many changes can be made to the embodiments described while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

The assignee of the present invention has a pending application that discloses the use of electroosmotic pumps in both closed-loop and open-loop microchannel cooling systems. This pending application is entitled "Electroosmotic Microchannel Cooling System", patent application Ser. No. 10/053,859, filed on Jan. 19, 2002, now U.S. Pat. No. 6,942,018. The complete disclosure of this pending patent application is hereby incorporated by reference.

The electroosmotic micropump with planar features described in various embodiments herein provides high pressure capacity. The planar features can be fabricated using standard microfabrication techniques including wet etching and thermal bonding. Therefore, electroosmotic micropumps with planar features can be directly integrated onto integrated circuits and Microsystems. The high pressure capacities make the planar micropump useful in high pressure load applications such as in liquid dosing, two-phase cooling and liquid crystal displays. The planar micropumps retain the advantages of porous media electroosmotic micropumps including the pumping of working fluid with a wide range of conductivities. Working fluids that can be used include organic solvents such as Acetonitrile, deionized water and buffered aqueous solutions.

Figure 1:
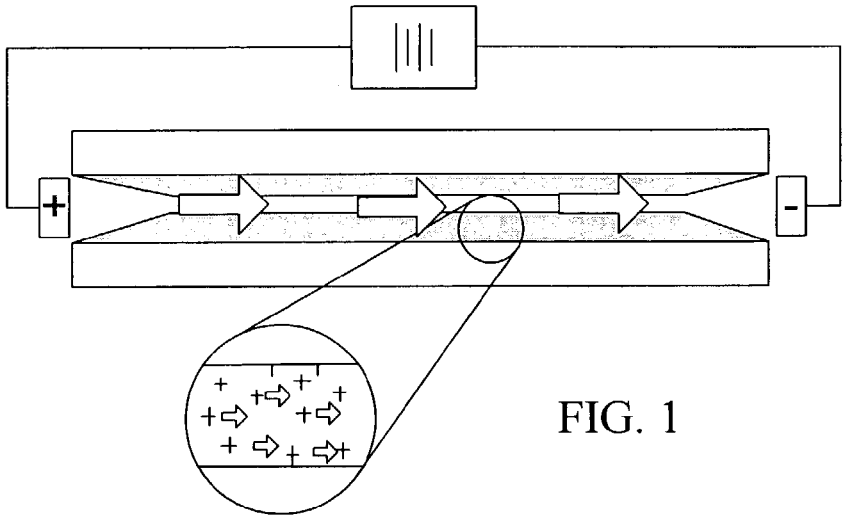
FIG. 1 illustrates electroosmotic flow between closely-spaced, parallel surfaces.

Referring to FIG. 1, it has been determined in the art that the average velocity of electroosmotic flow generated between two wide parallel surfaces by the application of an axial electric field Ex is:

$$\bar{v} = -\frac{a^2}{3\mu}\frac{dp}{dx} - \frac{\varepsilon\zeta}{\mu}E_x[1 - G(\alpha, \kappa a)]$$

where a is one-half the separation distance between the two pumping surfaces, μ is the fluid viscosity, dp/dx is the pressure gradient counter to the flow, ϵ is the fluid permittivity, ζ is the zeta potential, α is an ionic energy parameter, and G is a correction term for the thickness of the double layer. The wide parallel surfaces become charged, attracting counter-ions and repelling co-ions, to form a charge double layer. The outer layer of ions of the double layer are mobile. Applying an axial electric field exerts forces on the mobile ions and electromigration of the mobile ions drag the bulk fluid through viscous interaction. The zeta potential characterizes the effect of the surface condition on the electroosmotic flow. The zeta potential is determined from the net excess of surface charge-balancing ions near the surface/fluid interface.

In electroosmotic micropumps with planar features, working fluid is electroosmotically pumped parallel to one or more surfaces that are approximately flat. In one embodiment, working fluid is electroosmotically pumped between two flat surfaces that are approximately parallel to one another and which are separated by a distance much smaller than the planar dimensions of the surfaces. Because electroosmosis is largely a surface phenomenon, it is favored at smaller length scale compared to pressure-driven flow. Therefore, the pump can sustain high back pressure (e.g., >1 atm) when the gap between the surfaces is thin (e.g., 1 μm). In another embodiment, working fluid is pumped between a multitude of sets of two approximately flat surfaces, where for each set of two approximately flat surfaces, the two approximately flat surfaces are approximately parallel to one another and are separated by a distance much smaller than their planar dimensions.

Figure 2:
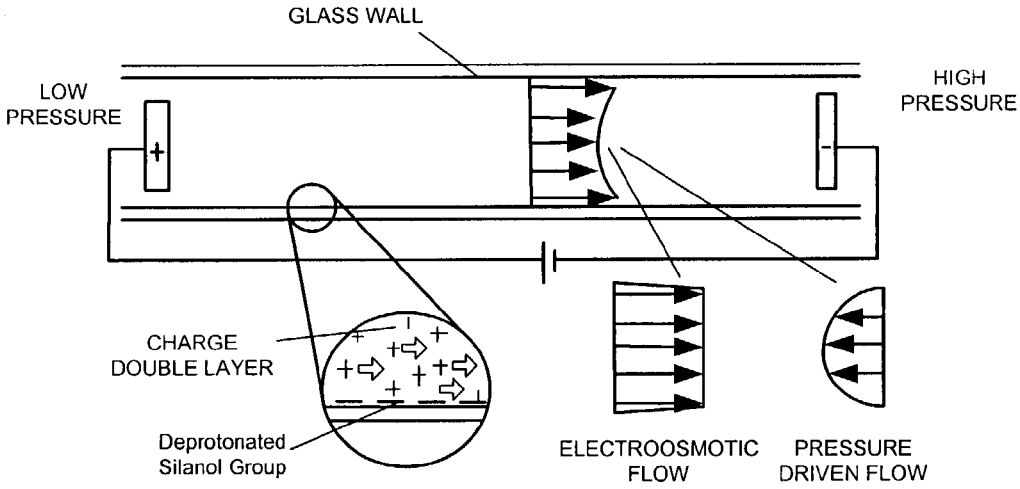
FIG. 2 illustrates the basic flow principle of electroosmotic micropumps.

FIG. 2 illustrates the basic flow principle of electroosmotic micropumps. When an aqueous solution contacts glass (or silica), the glass surface becomes negatively charged due to the depronation of surface silanol groups. An electrical double layer forms as a result of the depronation. The surface charge attracts dissolved counter-ions and repels co-ions, resulting in a charge separation. The Debye length is the characteristic thickness of the double layer. The mobile ions in the diffuse counter-ion layer are driven by an externally applied electrical field. The moving ions drag along bulk liquid through viscous force interaction. Also shown in FIG. 2 are the superposed effects of electroosmotic and pressure forces on the velocity profile.

Figure 8:
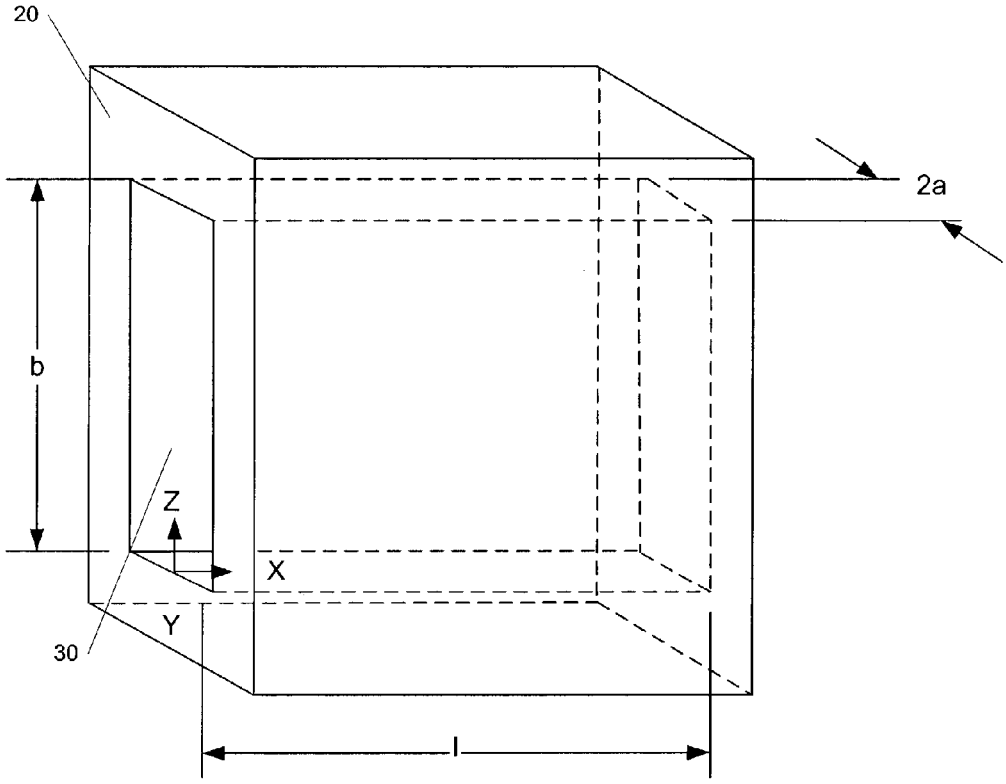
FIG. 8 illustrates the coordinate system and dimensions used to describe slots in the EO micropump of the invention.

FIG. 8 shows a schematic of a planar feature comprising two flat parallel surfaces. One or more such planar features are incorporated into the electroosmotic micropumps of the current invention. An electric field is applied along dimension L (denoted by the dashed arrows), giving rise to electroosmotic flow in the same direction. A shallow, short and wide planar feature characterizes the pump design. A shallow pump design (e.g., 2a=0.9 μm) is required to achieve high pressure capacity; a short pump design (e.g., L=1 mm) is required to achieve a high electric field and therefore a high electroosmotic flow rate; and a wide pump design (e.g., b=38 mm) is required to achieve a high flow area and therefore a high flow rate.

Figure 3A:
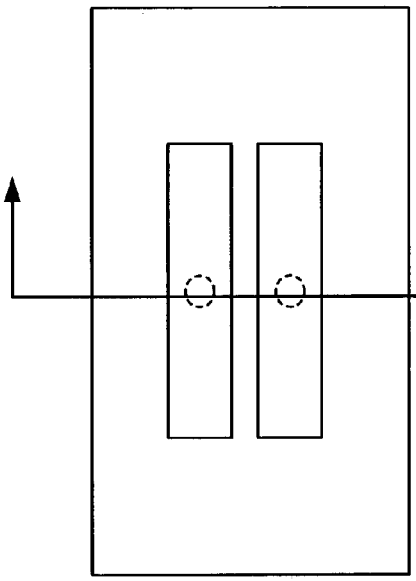
FIGS. 3A-3C illustrate aspects of the fabrication process for a planar, single slot electroosmotic micropump.
Figure 3B:
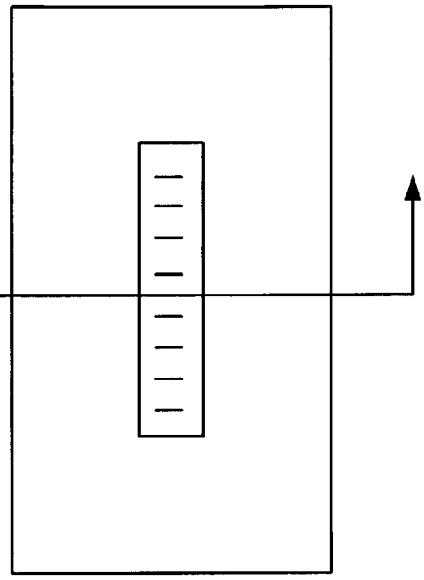
Figure 3C:
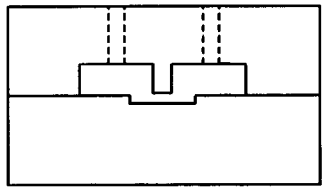

Standard microfabrication techniques are applied to fabricate the electroosmotic micropump with a planar feature. The fabrication process is described as follows:

(1) standard microlithography techniques are used to generate photoresist etch masks as shown in FIGS. 3A-3B for the pumping channel and fluid reservoirs. Note that ribs are incorporated in the mask for pumping channel to enhance structural strength (FIG. 3B);

(2) chemical wet etching using buffered oxide etch is used to fabricate the pumping channel and fluid reservoirs on soda-lime glass substrates (wet etching of two 50×75×1.2 mm soda-lime glass substrates produces 11-μm-deep fluid reservoirs and a 0.9-μm-deep pumping channel);

(3) two access holes are drilled in the center of the fluid reservoirs to serve as connections to external plumbing (shown in FIG. 3C); and (4) the top wall (with reservoirs) and pump structure substrates are thermally bonded together (FIG. 3C).

Despite the use of ribs to support the pump structure depicted in FIG. 3B, the planar pump fabricated using this geometrical design could experience collapse due to the high aspect ratio of flow passages. As a general rule for this particular design, the aspect ratio needs to be kept below 10 for best structural rigidity. For instance, for a pump depth (2a) of 0.9 μm, the separation between adjacent ribs needs to be kept below 9 μm.

The thermal bonding is a very tricky process due to the 0.9 μm pumping channel feature. The thermal bonding was found to be very sensitive to the bonding process including maximum temperature, duration, and the amount and distribution of weight applied to promote bonding. In one experiment, the glass substrates were first cleaned using a piranha cleaning solution (i.e., a 4:1 ratio of sulfuric acid to hydrogen peroxide). The two substrates were then aligned, and placed in a dental oven (e.g., the Centuriun Q200 available from Ney Dental of Bloomfield, Conn.) for bonding. A stainless steel weight of 6 kg was centered on top of the substrates. The oven cycle began at 200° C., ramped at 10° C./min to 575° C., dwelled at 575° C. for 90 minute cooled down to 200° C. after 30 min. The pressure in the oven was kept below 3 kPa during the bonding.

One important aspect of planar pump design is the optimization of the electrokinetic channel half height (a'). Electrokinetic channel half height a' is defined as $$a' = \frac{a}{\lambda_D},$$

where a is the channel half height, and $\lambda_D$ is the Debye length defined as $$\lambda_D = \sqrt{\frac{\varepsilon RT}{2F^2z^2c}} \propto \frac{1}{\sqrt{c}}$$

where ϵ is permittivity, R is the universal gas constant, F is the Faraday number, z is the valence number, and c is the concentration of working fluid. The pressure and flow rate are both proportional to:

$$f(a') = 1 - \frac{\tanh(a')}{a'}$$

which is a monotonic function of a'. Physically, at low a', a significant portion of the channel height is within the electric double layer, which has an electroosmotic velocity deficit.

Thermodynamic efficiency is defined as:

$$h = \frac{W_P}{W_T}$$

where $W_P$ is the useful pressure output, and $W_T$ is the total power consumption. The peak at a median a' results from the competing influence of two effects: low flow capacities due to electroosmotic velocity deficit at low a', and high joule heating due to higher ionic concentration at high a'.

Experimentally, the optimization of a' involves the geometrical design of channel height (2h), and the choice of the ionic concentration of the working fluid. As an example of such optimization if the channel height is chosen as 0.9 μm and the working fluid is chosen as DI water (ionic conductivity=$3.0\times10^{-4}$ S/m, pH=5.7), the resulting electrokinetic channel half height is a'=4.

Figure 17:
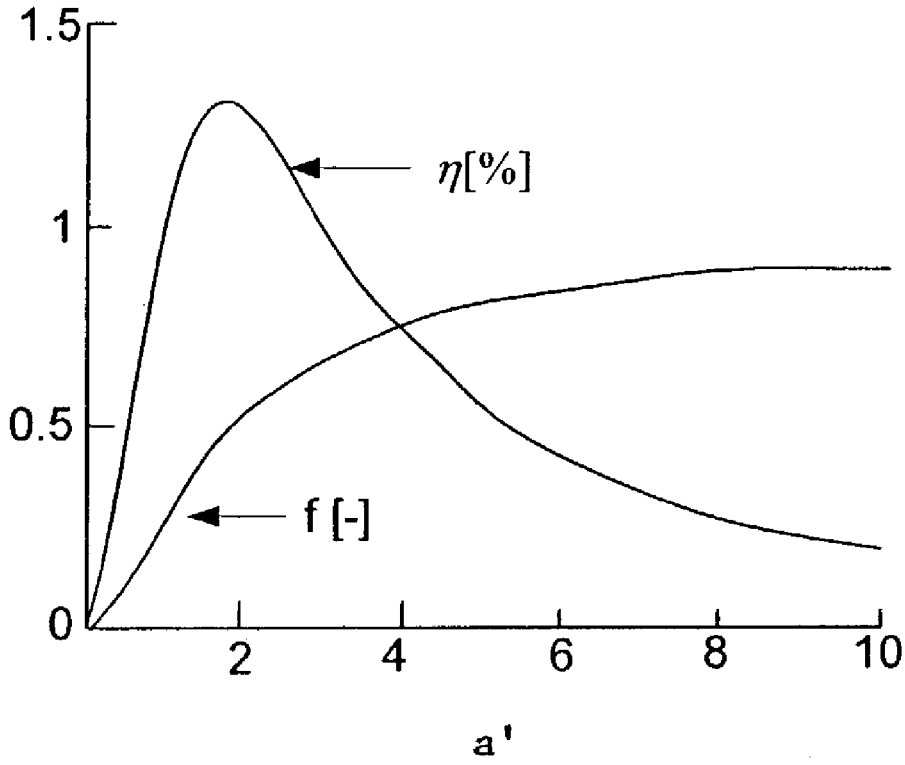
FIG. 17 illustrates a graph of flow capacities (both pressure and flow rate) and thermodynamic efficiency of an electrokinetic channel as a function of the channel half height.

As shown in FIG. 17, the flow capacities including pressure and flow rate are both proportional to f(a'), which is a monotonic function of a'. Thermodynamic efficiency is plotted as η(a'), which peaks at an electrokinetic channel half height of 2. If only flow capacities are concerned, a' should be higher than 10. If only thermodynamic efficiency is concerned, a' should be chosen close to 2. However, for optimization of both flow capacities and thermodynamic efficiency, the electrokinetic channel half height should be around 5.

Figure 4:
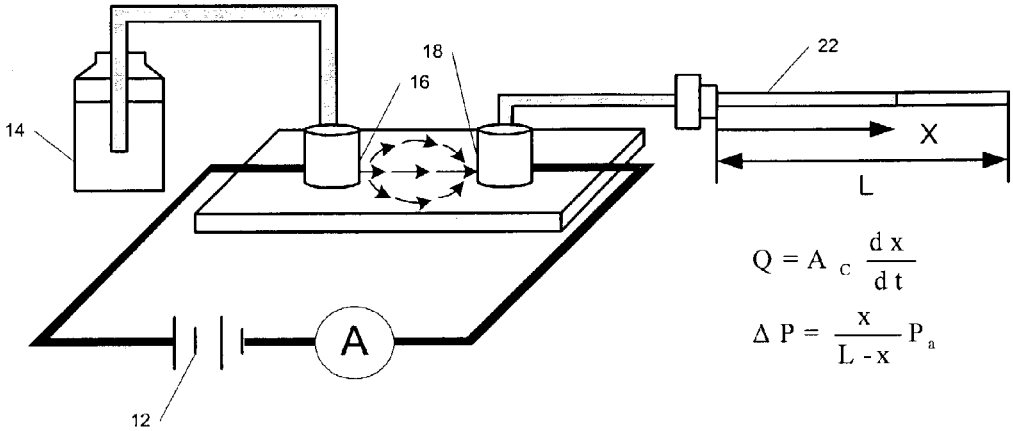
FIG. 4 illustrates a planar electroosmotic micropump setup for characterization of pump performance.
Figure 5:
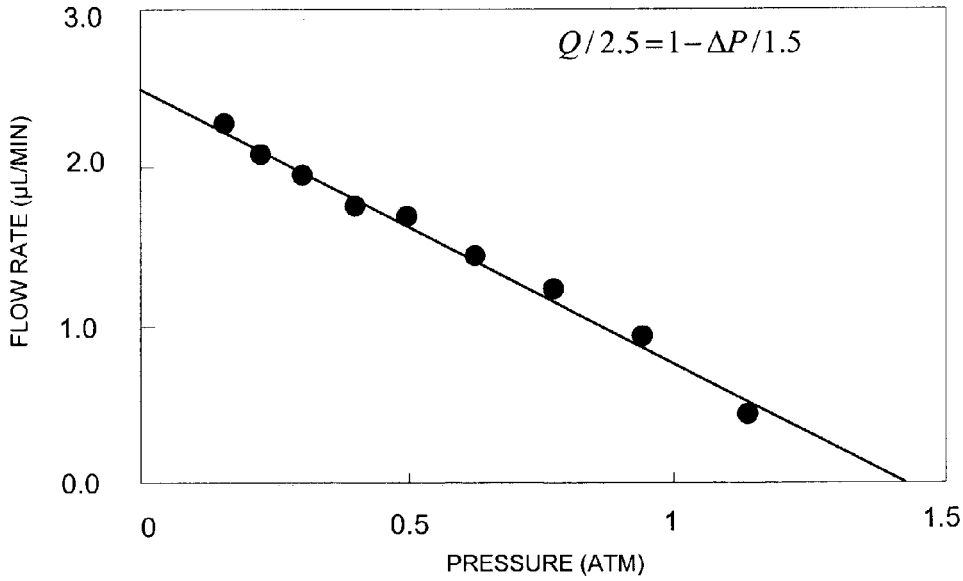
FIG. 5 illustrates the pressure/flow rate performance of a planar, single slot electroosmotic micropump.

FIG. 4 shows the setup for characterization of micropump performance. High performance liquid chromatography polyethylethylketone (PEEK) fittings (not shown) were connected to the access holes in fluid reservoirs 16, 18 using UV-curable epoxy, and stainless steel unions (not shown) were attached to serve as both interconnects and electrodes. PEEK fittings can withstand very high pressures. The positive electrode is connected to a container of working fluid (DI water) 14 and the negative electrode is connected to a test section 22. When high voltage 12 is applied, the micropump drives the working fluid from the external liquid reservoir 14 to the characterization setup. The test section 22 is composed of a circular silica capillary with an inner diameter of 700 μm. When the test tube is open, maximum flow rate is obtained by tracing the flow front. When the test tube is closed, both flow rate and its associated counter pressure are detected simultaneously.

The major source of error for the flow rate measurement is the evaporation of the working fluid at the flow front for the open tube case, and the uncertainty in recording the flow front for the closed tube case. The major source of error for pressure measurement is the ambiguity associated with the total length of the test section. The absolute errors in flow rate and pressure measurements are small compared to typical flow rate and pressure measurements.

Deionized (DI) water (pH=5.7) with a low conductivity of $3.0\times10^{-4}$ S/m is used to achieve a near-optimal thermodynamic efficiency. At 3 kV, the micropump achieved a maximum flow rate of 2.5 μL/min, and a maximum pressure of 1.5 atm.

Figure 18:
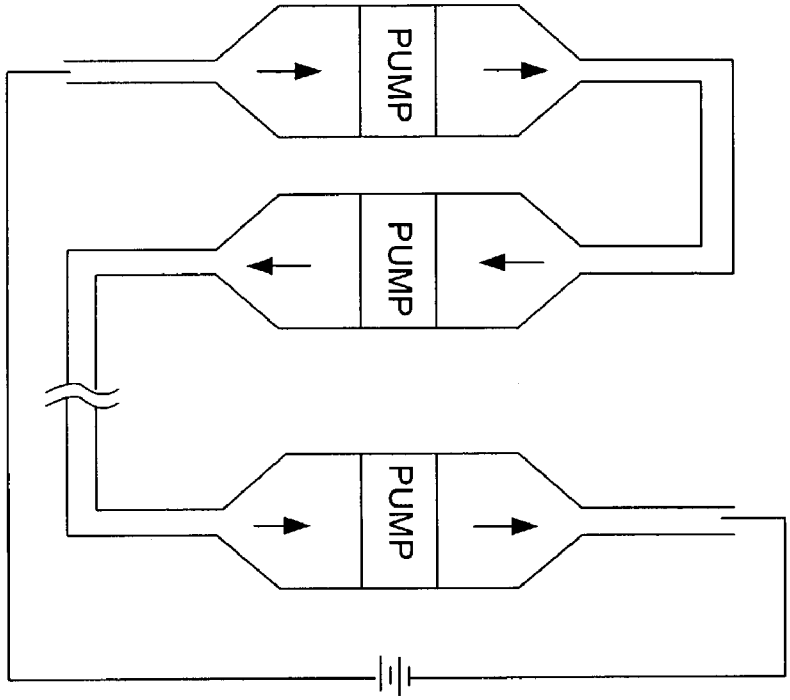
FIG. 18 illustrates an exemplary embodiment of multiple planar pumps arranged in a series configuration.

The following paragraphs describe several applications of electroosmotic micropumps with planar features. Multiple pumps can be used in series to enhance pressure capacity, and an exemplary implementation is illustrated in FIG. 18. A single electroosmotic pump usually has a limited capacity for heat dissipation and therefore a limit for applied voltage. This constraint limits the pressure capacity, which is proportional to the applied voltage. A series of multiple pumps can sustain higher applied voltages and therefore produce higher pressures. The direction of electroosmotic flow in FIG. 18 is depicted by the arrows. This design enables the application of high voltage on the series of EO micropumps without exceeding the voltage limit on each individual micropump.

Figure 19:
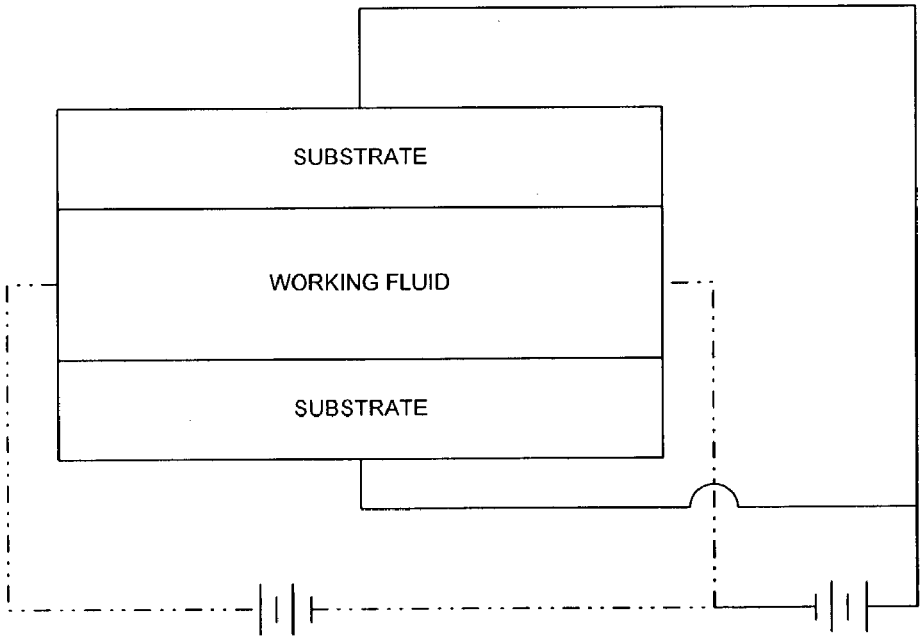
FIG. 19 illustrates the use of a transverse electric field to change the zeta potential and thereby affect electroosmotic flow.

In another application that utilizes the transverse electric field, the zeta potential of the pump wall can be altered, and as a result, the electroosmotic flow can be enhanced, reduced, or even reversed. In the embodiment illustrated in FIG. 19, a transverse electric field can be applied to change the zeta potential of the pump. The normal voltage for electroosmotic pumping (Vp) and the controlling voltage to produce transverse electric field (Vc) share the same ground. This design improves the versatility of the electroosmotic pump and enables its use in complex control systems such as liquid crystal display and optical switching.

Figure 20:
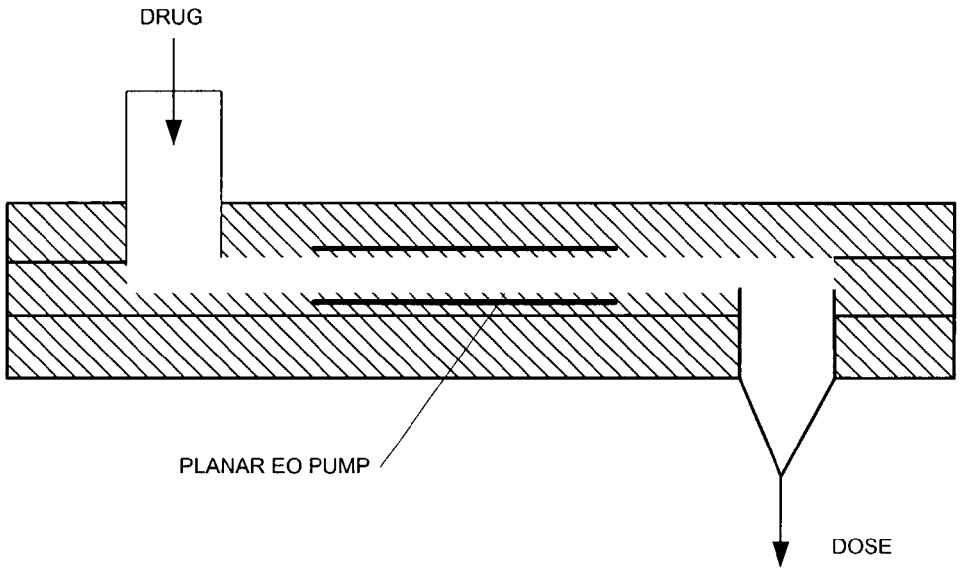
FIG. 20 illustrates an exemplary use of a planar electroosmotic pump for drug dosing.
Figure 21:
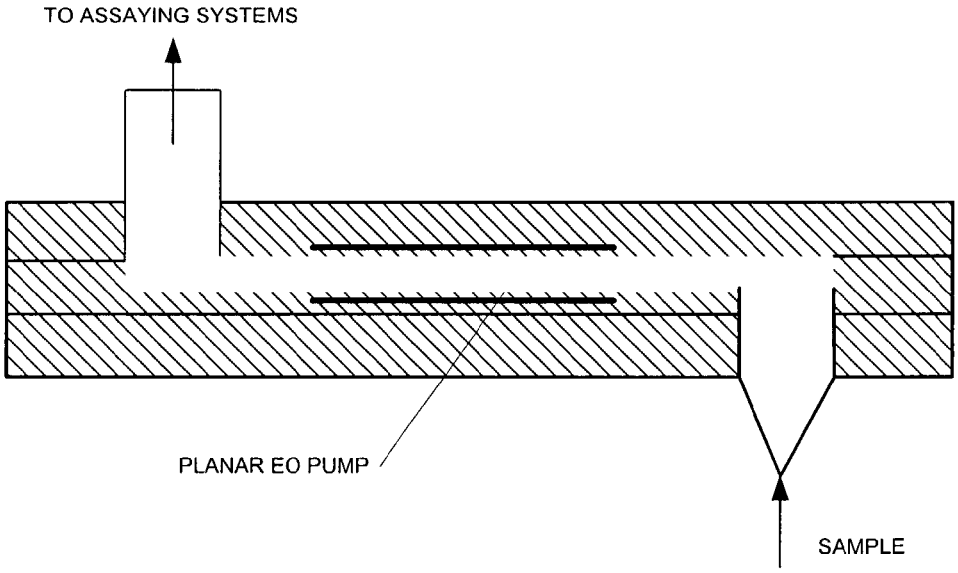
FIG. 21 illustrates an exemplary use of a planar electroosmotic pump for sample extraction.

The EO pump with planar features is also well-suited for integrated microsystems. For example, a single EO pump with planar features can drive a drug dispensing system. As shown in FIG. 20, the electroosmotic pump can be integrated onto drug-dosing microsystems. Drug dosing is driven by the high-pressure EO pump which can produce uniform dosing at the dispensing tip. If the flow direction is reversed, the EO pump can drive a sample-extracting system. As shown in FIG. 21, the electroosmotic pump can be integrated onto sample-extracting microsystems. Samples like human blood can be extracted through the planar pump for further analysis. In these embodiments, the high-pressure capacity will help dispensing with uniform size and extracting of viscous samples. In addition, unlike most non-mechanical pumps, EO pumps drive liquids with a wide range of conductivities including dielectrics and electrolytes.

Figure 6:
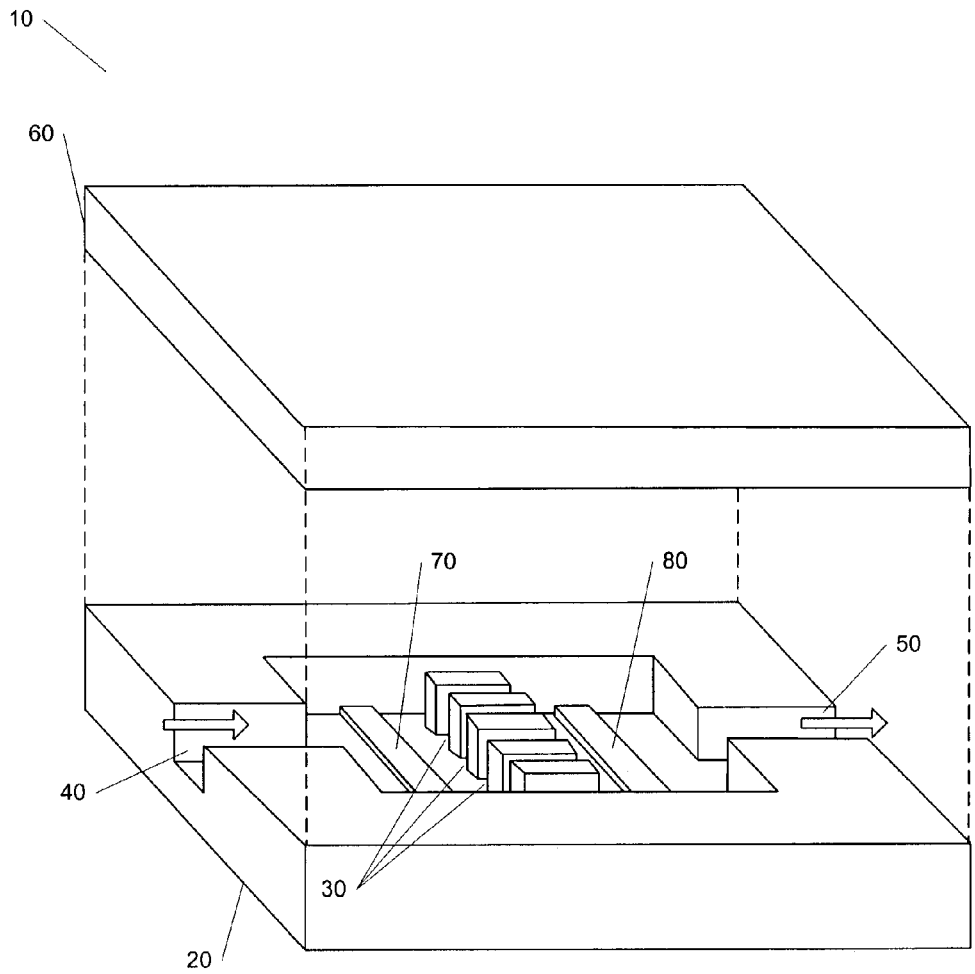
FIG. 6 illustrates an exemplary structure of an electroosmotic pump with multiple slots.

FIG. 6 illustrates an electroosmotic micropump 10 made in part from a silicon substrate 20. Within the silicon portion of the electroosmotic micropump is a region containing a multitude of planar features passing through a block of silicon 20, as shown in the figure. The surfaces of the planar features are perpendicular to the surface of the silicon substrate. The planar features 30 and the block of material 20 through which they pass are referred to as the electroosmotic flow (EOF) pumping region. The planar features 30 in the EOF pumping region can be formed by deep reactive ion enhanced etching or by other means, including liquid-phase chemical etching that is selective for certain crystal planes of the silicon, following patterning of the silicon substrate 20 using photolithography or other means. In one embodiment, the planar features are approximately the same in size and shape.

Figure 7:
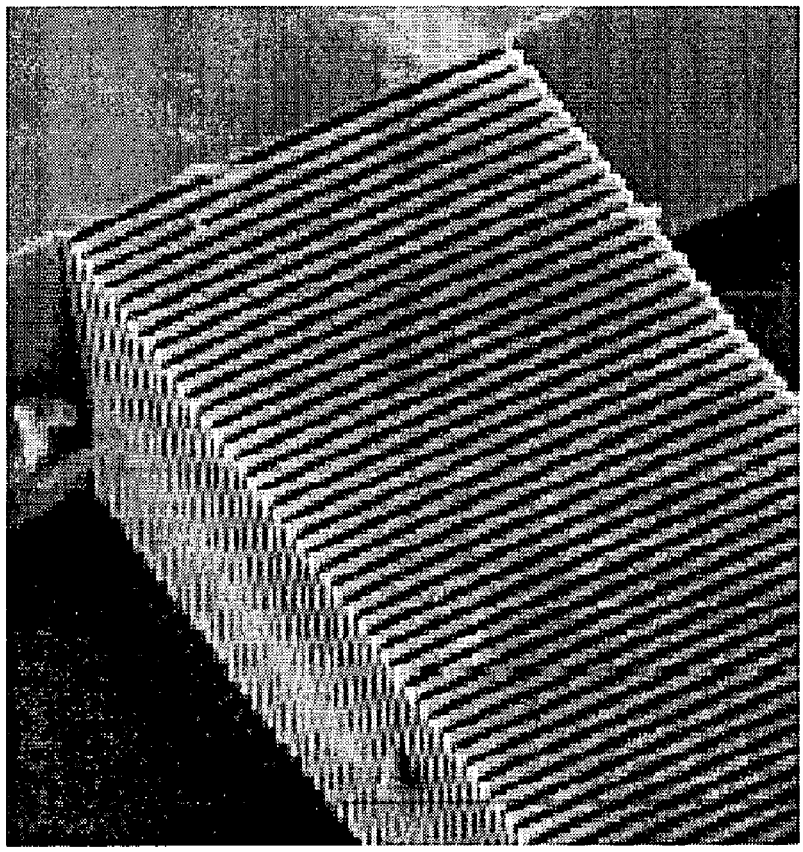
FIG. 7 illustrates a scanning electron micrograph of the electroosmotic flow (EOF) pumping region in an EO pump fabricated by photolithographic processing of a silicon wafer.

FIG. 7 shows a scanning electron micrograph of a portion of an EOF pumping region that was made by deep reactive ion-enhanced etching of a silicon substrate patterned using photolithography. As shown in FIG. 8, the cross-sectional dimensions of a planar feature 30 are defined as b and 2a, where 2a<b. In general, the flow rate that the pump can produce monotonically increases with increasing n, where n represents the number of slots.

Deep reactive ion enhanced etching of a patterned silicon substrates is particularly well suited for producing EOF pumping regions with favorable geometries, i.e., a large number of closely-spaced planar features.

The pump also contains inlet 40 and outlet manifolds 50 on either side of the pumping region as shown in FIG. 6. A cover 60 made from glass, silicon, or another material seals the pumping region and the manifolds 40, 50. The cover 60 may be bonded to the silicon substrate 20 by means of anodic bonding, fusion bonding, or by other bonding means (e.g., eutectic, adhesive). Located in or near each manifold 40, 50 are electrodes 70, 80 by means of which an electrical potential can be applied to the pumped solution during pump operation. The electrodes 70, 80 may be deposited onto the silicon substrate 20 or onto the cover 60 or may consist of wires positioned above or inserted directly into the manifold through ports in the silicon substrate or cover. There are inlet and outlet ports for the fluid in either the silicon substrate or the cover. The ports for the fluid and the electrical connection may be holes formed in the silicon substrate 20 or the cover 60 or slots 30 (formed by etching or other means) connecting the manifold and the edge of the pump.

As shown in FIG. 8, the dimension of a planar feature in the EOF pumping region perpendicular to the cross-sectional area of the slot is defined as slot length, 1. Typically, planar feature length 1 is less than 5 mm. In general, the flow rate that the pump can produce per unit applied voltage monotonically increases with decreasing slot length 1.

Figure 9:
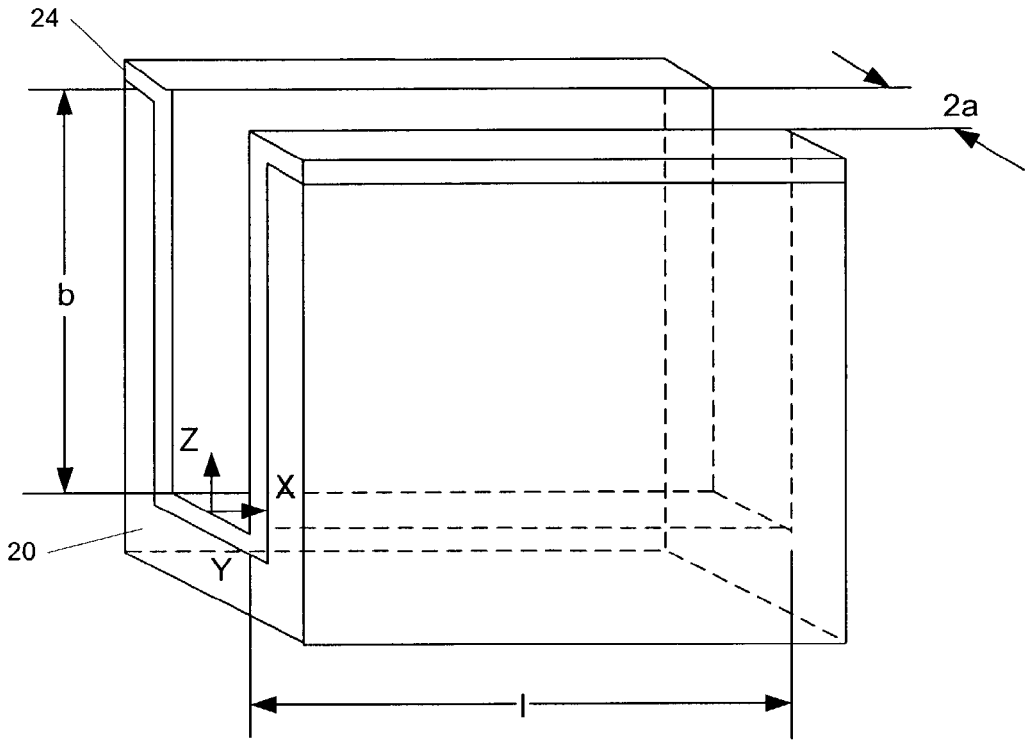
FIG. 9 illustrates a cutaway section perspective view of a single pump slot having a layer of dielectric material to insulate the silicon substrate.

The silicon substrate 20 is typically coated with a layer 24 of material that provides electrical insulation, as shown in FIG. 9. This insulating layer 24 is necessary to limit the flow of electrical current through the silicon substrate 20 during operation. An electric field is applied to the pumping solution during pump operation; without insulation, a current path exists from one electrode to another through the silicon substrate 20. Current flow through the silicon substrate 20 does not contribute to pumping and therefore decreases pump efficiency. It can also lead to potentially deleterious effects such as heating of the substrate. Extensive experimentation with different choices of insulating material has determined that many thin-film dielectrics that are adequate for solid-state applications perform poorly when placed in contact with a liquid phase, as is the case in the electroosmotic micropumps. Therefore, in an exemplary embodiment, the silicon substrate 20 is insulated from the liquid phase by a near-stoichiometric silicon nitride film ($Si_3N_4$). This film 24 may be deposited at low pressure through a chemical vapor deposition process or applied through other means. This film 24 may either be located directly on top of the silicon substrate 20 or on top of an intermediate layer. The thickness of this film may range from 50 nm to 1 μm, with thicker films typically allowing higher electric potentials to be applied during pump operation. A near-stoichiometric silicon nitride film with a thickness of 200-500 nm has been found to insulate the silicon substrate 20 well enough to allow voltage potential differences of up to at least 500 volts to be applied during pump operation.

Although a near-stoichiometric silicon nitride film is used in the exemplary embodiment described herein, silicon nitride as used in the claims below refers, more generally, to materials that are comprised primarily of silicon and nitrogen elements. Making the silicon nitride compound deposited on the substrate a little rich in silicon enables the application of a relatively thick film without causing stress-related problems. However, if the silicon nitride compound is too rich in silicon, it will not provide adequate insulation, which is the reason for using the silicon nitride film.

Figure 10:
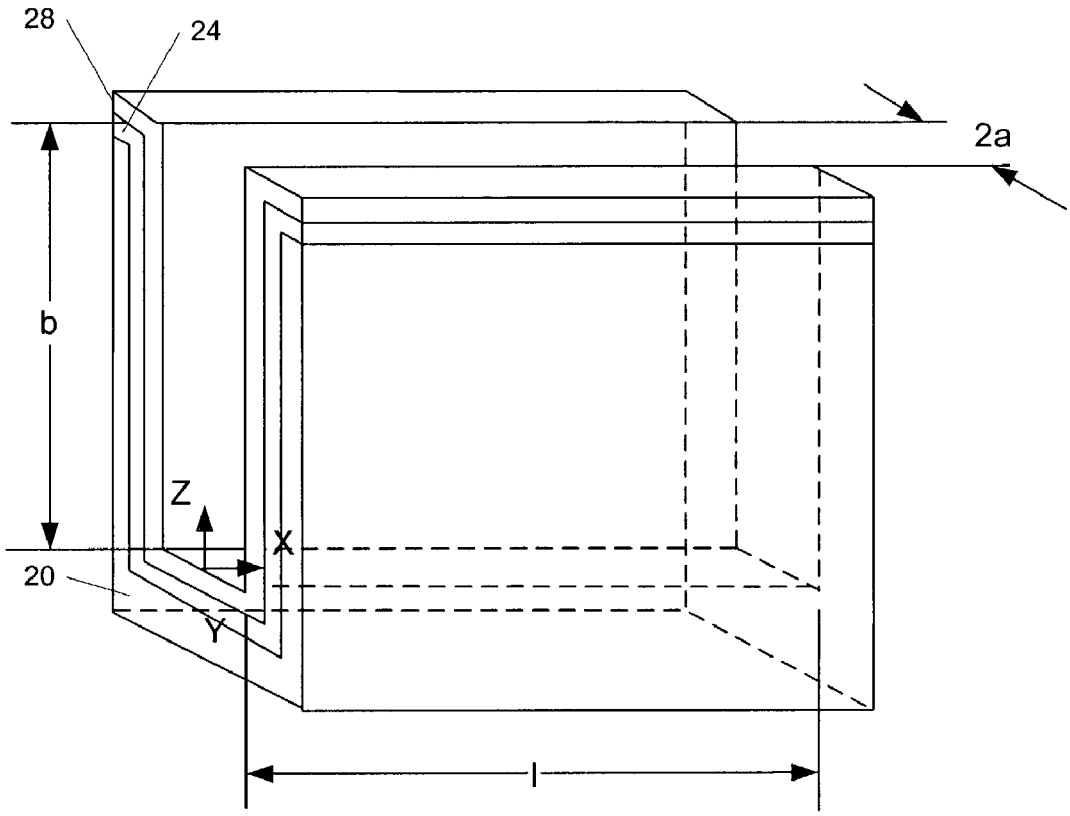
FIG. 10 illustrates a cutaway section perspective view of a single pump slot with a surface treatment to improve EO pump performance.
Figure 11:
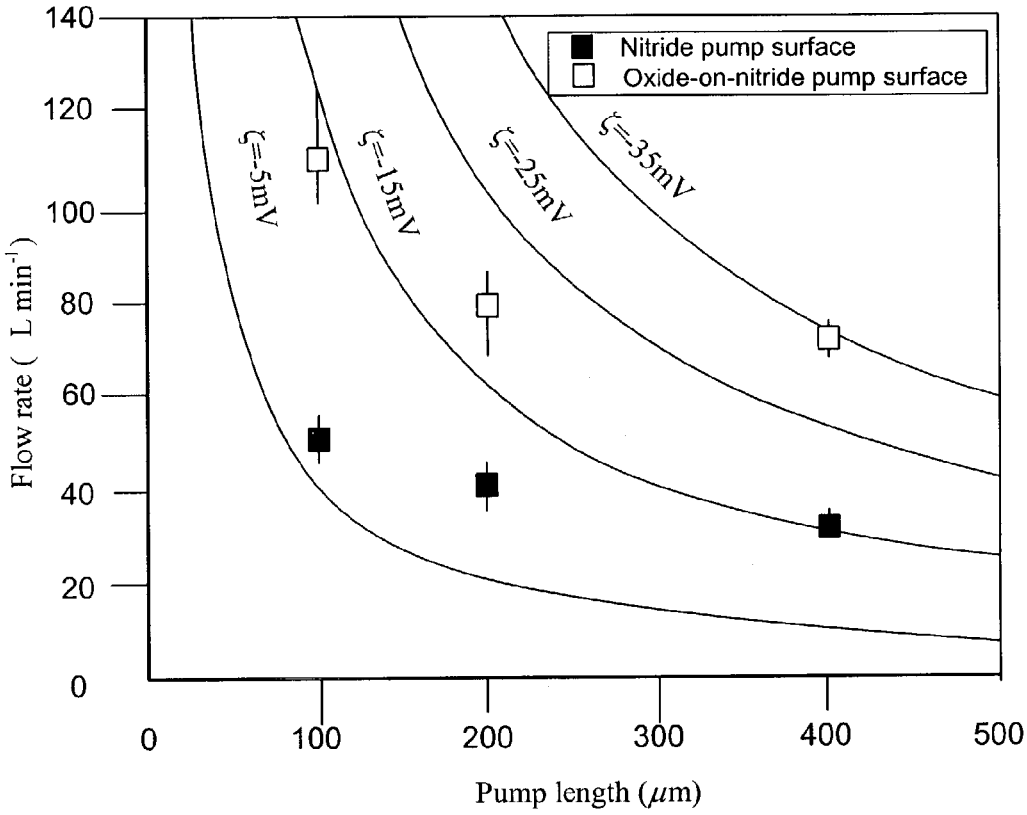
FIG. 11 illustrates the maximum flow rates produced by silicon EO micropumps with different pump surfaces.

The performance of electroosmotic pumps depends on the electrochemistry of the interface between the liquid that is pumped and the surface of the pump that contacts the pumped liquid. Modifying the pump surface composition is difficult in pumps with high aspect ratio slots (i.e., where b>>2a). Experiments have been conducted with a number of surface coatings and treatments. One treatment has proven particularly effective, after coating the silicon substrate 20 with a layer of near-stoichiometric silicon nitride, a layer 28 of polysilicon is deposited at low pressure to form the liquid-solid interface. The thickness of the polysilicon layer 28 is typically on the order of 100 nm. The polysilicon layer 28 coats the substrate in a highly conformal manner. The polysilicon layer is then oxidized in its entirety, e.g., in a furnace at a temperature above 700° C. with or without steam present. The resulting pump structure is shown in FIG. 10. This surface treatment results in pumps that perform substantially better than comparable pumps that have not been so treated, as shown in the graphic display of FIG. 11. The maximum flow rate produced by pumps with the oxidized polysilicon surface is twice that produced by comparable electroosmotic micropumps with an untreated silicon nitride surface.

More generally, other materials can be used for the second layer. For example, a silicon oxide material can be used as the second or additional layer. The silicon oxide layer could be applied by a process such as plasma-enhanced chemical vapor deposition. The material used for the liquid-solid interface can be something other than an oxide layer, but should be a dielectric material. The material selected should provide the desired electrochemistry properties at the liquid-solid interface in order to enhance pump performance.

The design of the electroosmotic micropump of the present invention is such that it has a large cross-sectional area through which fluid is pumped. The planar feature dimension 2*a* can be chosen such that the electroosmotic micropump produces high pressures. The electroosmotic micropump can be manufactured using photolithography-based fabrication processes of the sort developed for the integrated circuit industry, allowing it to be integrated with circuitry or other microfabricated devices. The near-stoichiometric silicon nitride coating on the silicon substrate reduces electrical current flowing through the substrate during pump operation. The oxidized silicon layer that contacts the pumped liquid during operation improves pump performance.

Electroosmotic micropumps manufactured on silicon substrates using standard micromachining processes can generate pressures of 5 kPa and flow rates of 110 μL/min at 200 V. This novel micromachined silicon electroosmotic micropump structure dramatically reduces die size requirements. In one application of the present invention, the use of electroosmotic micropumps in microscale fluidic actuation has been investigated by integrating a silicon membrane structure into the micropump system. By monitoring the velocity of the membrane using a laser vibrometer, the micropump's pressure response on timescales below 100 milliseconds can be characterized. The silicon electroosmotic micropumps investigated have been found to have a finite pressure response within 10 ms of power activation. Maximum pressure generation, however, appears to take place on a much longer timescale.

Low-voltage electroosmotic micropumps can be fabricated using silicon micromachining in a relatively straightforward manner. The ready integration of micromachined silicon electroosmotic micropumps with other micromachined components makes microactuation a potential application of these micropumps.

Actuator response time is a critical figure of merit for microscale device actuation applications. For micromachined electrostatic comb drive actuators, this response time is generally limited by inertia and is on the order of 1 millisecond or less as has been reported in the prior art. In contrast, the response time of a fluidic actuator can be limited by a wide range of factors, including the inertia of the fluid, the finite velocity with which a pressure wave propagates through the fluid medium, and, for devices that rely on electric-field-mediated pumps such as electroosmotic pumps, electrochemical effects. In microfluidic actuators, gas bubbles in the fluid and mechanical compliance of fixturing (e.g., attaching fluidic interconnects) and tubing are a source of volume capacitance that can reduce response time.

Figure 12:
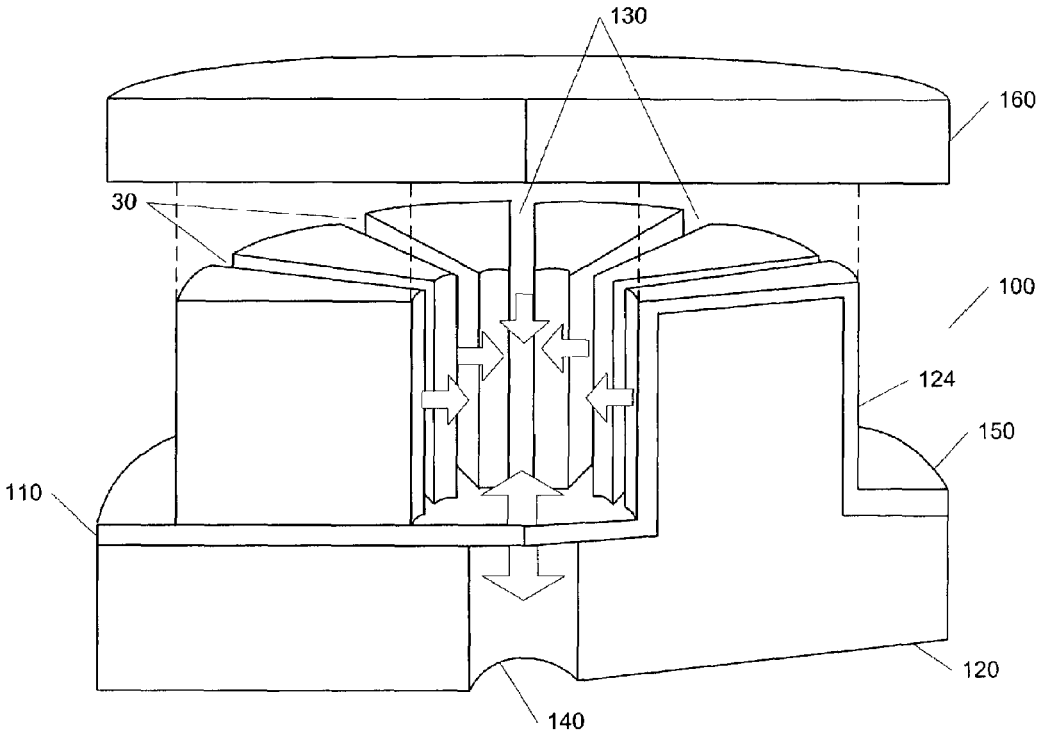
FIG. 12 illustrates the structure of a microactuator with an integrated, concentric deep-etched annular electroosmotic pump in one application of the present invention.

To evaluate the usefulness of silicon electroosmotic micropumps for microactuation, simple microactuators with integrated electroosmotic micropumps have been fabricated. The actuated component is a circular silicon nitride membrane 110 located at the center of an annular electroosmotic micropump 100, as shown in FIG. 12. The design of this device is intended to minimize the impact on response time of finite pressure wave propagation velocity, system volume capacitance, and the membrane's mechanical properties. Therefore, the system can be used to determine the lower limit on the response time of a microactuator driven by the annular electroosmotic micropump 100.

Channels with the micron-scale dimensions appropriate for electroosmotic pumping may be readily fabricated using silicon micromachining, but the silicon substrate limits the electrical potential that can be applied during pump operation to approximately 500 V, even with thin-film insulation.

Electroosmotic pumps can be made in silicon by etching a 5 cm wide, 1.5 μm deep, 500 μm long channel in a silicon substrate, coating the substrate with silicon nitride, and sealing with an anodically bonded borosilicate glass cover generate pressures of 2 kPa and flow rates of 5 μL/min at 500 volts, compared to 150 kPa and 2.3 μL/min for a glass micropump with a similar design operating at 3 kV. The difference in the performance of these pumps is attributable to the different zeta potentials of silicon nitride and glass as well as to the difference in applied voltage. Both pumps occupy an area of approximately 5 $cm^2$ on the substrate, including the etched channels required to transport fluid to and from the pumping channel.

To improve the flow rate generated by the silicon electroosmotic micropump relative to its size, 3 μm wide planar features can be plasma etched perpendicular to the silicon substrate to a depth of approximately 100 μm. Subsequent conformal deposition of approximately 0.65 μm of silicon nitride reduces the slot width to 1.7 μm. Spacing the slots every 10 μm yields a 20× improvement in flow area per unit substrate surface area over the previous design. By arranging the slots 130 in an annular configuration as shown in FIG.

Figure 13:
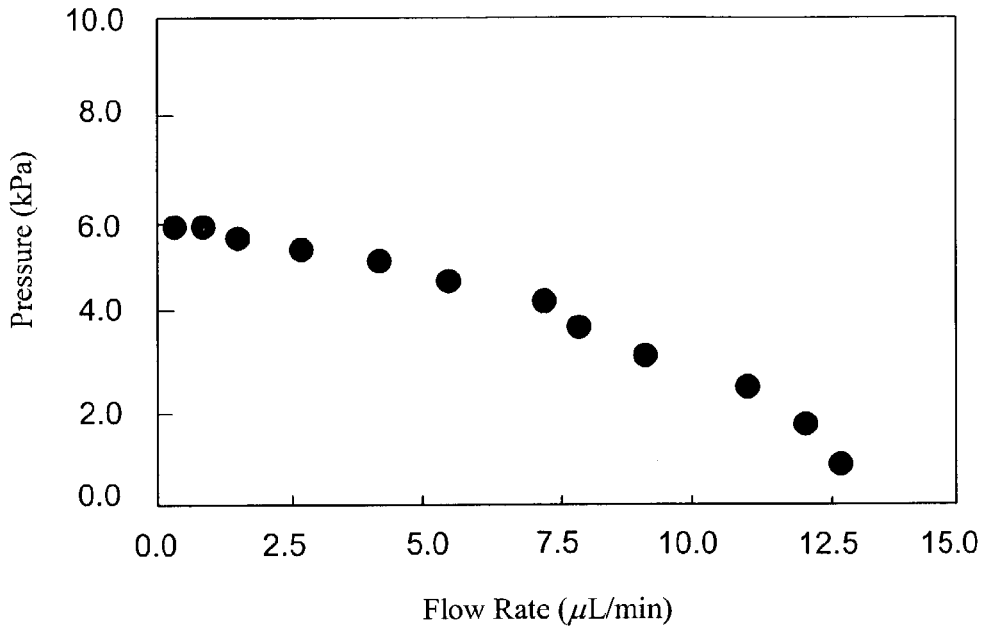
FIG. 13 illustrates the pressure/flow rate performance of a silicon electroosmotic micropump in an annular configuration.

12, a micropump 100 has been produced with a flow area of approximately $7.2\times10^4$ $\mu m^2$ that fits on a 1 cm×2 cm die. Fabrication of the micropump is completed by anodically bonding a Pyrex 7740 wafer 160 to the top side of the silicon wafer 120 by applying a potential difference of 1200 volts across the two wafers for 30 minutes at 350° C. The devices are then diced and access holes drilled in the glass cover 160 using a diamond-tipped drill bit. Fluid and electrical connections are made through 2 cm glass capillary segments attached to the micropump 100 using UV-cured epoxy. This micropump 100 generates a maximum pressure of 6 kPa and a maximum flow rate of 13 μL/min at 400 V. Power consumption is less than 150 mW. The pressure-flow rate characteristics of the pump, found by measuring compression of room air in a closed capillary, are plotted in FIG. 13. The margin of error with this measurement technique is approximately +/−0.25 kPa.

The annular electroosmotic pump 100 described above is converted to an actuator by releasing a circular area of the silicon nitride coating at the center of the interior well using a backside plasma etch. As shown in FIG. 12, the layer of silicon nitride 124 insulates the surface of the inner well 140, outer annulus 150, and slots 130 and forms the membrane 110. Devices with membrane diameters of 250 μm and 500 μm have been fabricated. A 300 angstrom layer of gold with a 50 angstrom chrome adhesion layer is evaporatively deposited on the back side of each die to increase the reflectivity of the nitride membrane. The yield of the microactuator fabrication process is approximately 75%, with the lost yield mostly due to exposure issues with thick resist lithography.

The velocity of the membrane during operation can be monitored using a laser vibrometer. Pump current can be monitored during testing using a series reference resistor. Data can be collected using a 1.5 GHz digital oscilloscope. The use of the vibrometer to conduct measurements of membrane velocity, wherein the membrane is within a millimeter of each of the radially-arrayed pump slots micropump, affords a unique capability for resolving the high-speed temporal response of the microactuator (and, in turn, of the micropump). Noise limits the vibrometer's velocity resolution to a few hundred nanometers per second during microactuator testing. A finite element model indicates that applying a 6 kPa differential pressure, which is the maximum generated by the electroosmotic micropump at 400 V, will result in a steady-state maximum membrane displacement of over 1 μm for the 250 μm diameter membrane and over 6 μm for the 500 μm membrane. A portion of the steady-state pressure developed by electroosmotic micropumps arises on a timescale of seconds or longer. Such response times are associated with membrane velocities of 10 nm/sec or less, velocities that are below the resolution limit of the vibrometer. Because of this limitation, the results described herein address only the fast transient response (<100 millisecond) of the microactuator.

A further limitation on the accuracy of the measurements is imposed by vibrometer laser focusing and alignment issues. The velocity measured by the vibrometer is the average velocity of the region of the membrane illuminated by the laser. This is a circular area with a diameter of approximately 20 μm. Using a micrometer stage, the laser can be focused within an estimated 25 μm of the center of the membrane. The finite spot size of the laser and potential misalignment of the laser with the center of the membrane can be expected to result in underestimation of the membrane maximum displacement by as much as 20%.

Figure 14:
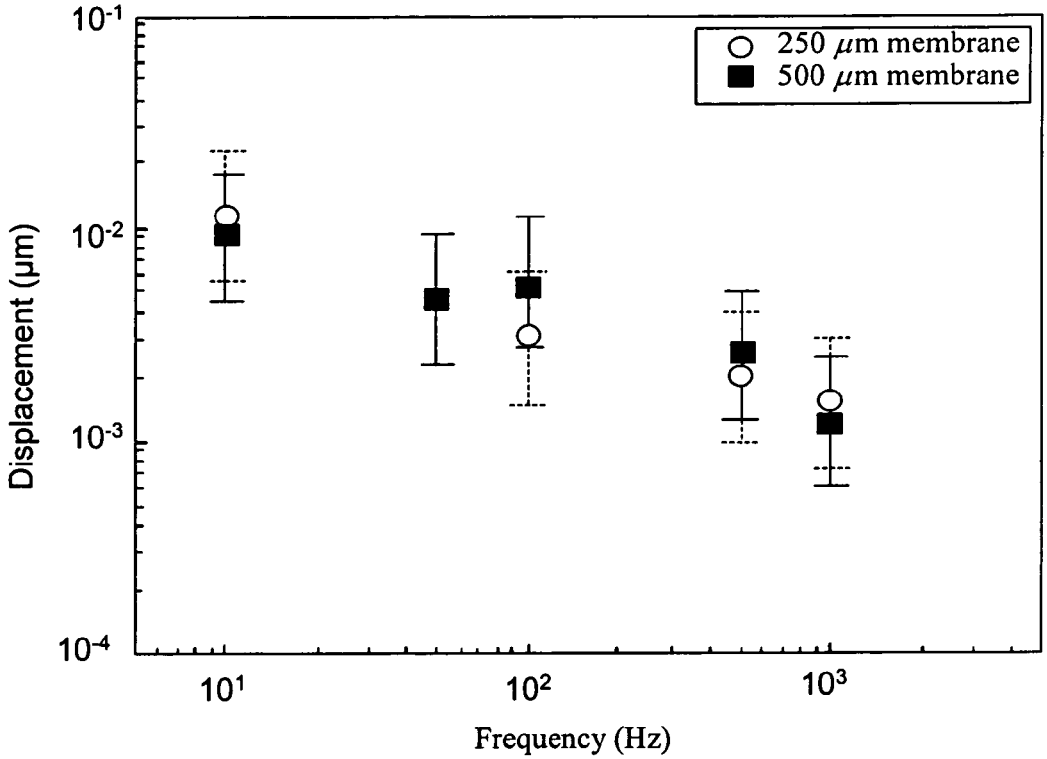
FIG. 14 illustrates a graph of nitride membrane displacement as a function of frequency for an electroosmotic micropump.

The microactuators described herein were tested by applying a 400 Vp-p sinusoidal input with a 200 V offset to the pump at frequencies ranging from 10 Hz to 1 kHz. At each frequency, data for at least 256 cycles was acquired and averaged to reduce noise in the measurement. Displacement data was calculated by integrating the velocity measured by the vibrometer. The measured velocity represents the average velocity of the portion of the membrane area illuminated by the vibrometer. Membrane displacement amplitude is plotted as a function of frequency in FIG. 14.

Figure 15A:
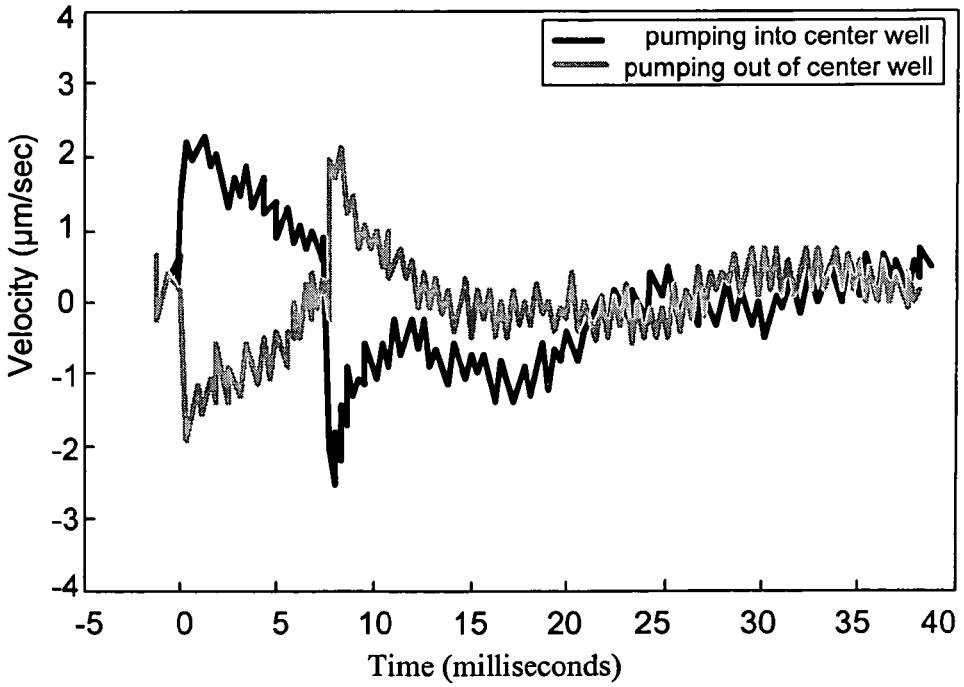
FIGS. 15A-15C illustrate the bi-directional response of a microactuator with an integrated annular electroosmotic micropump.
Figure 15B:
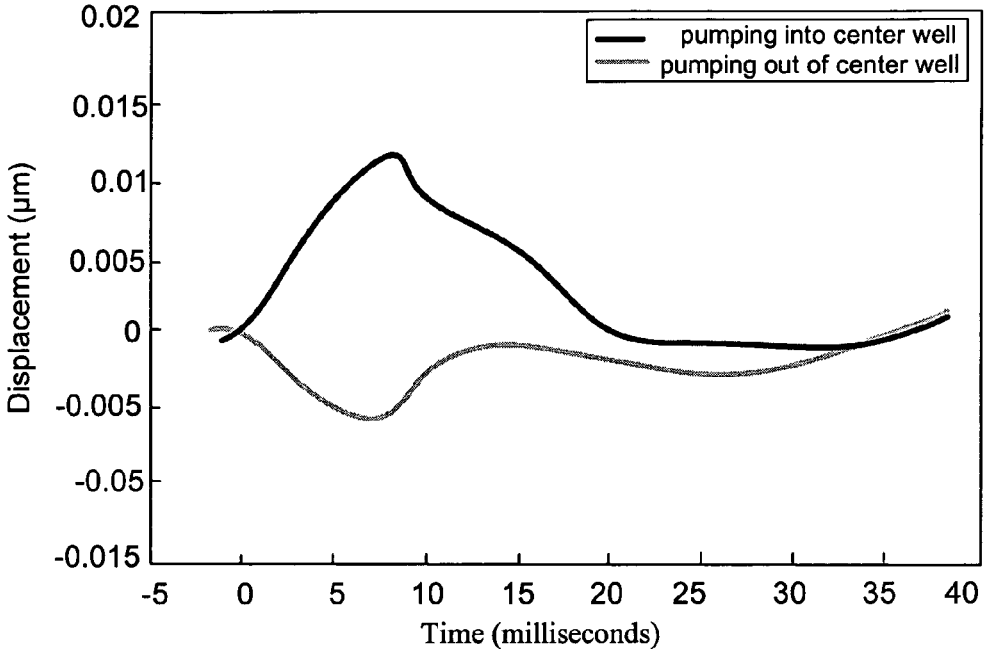
Figure 15C:
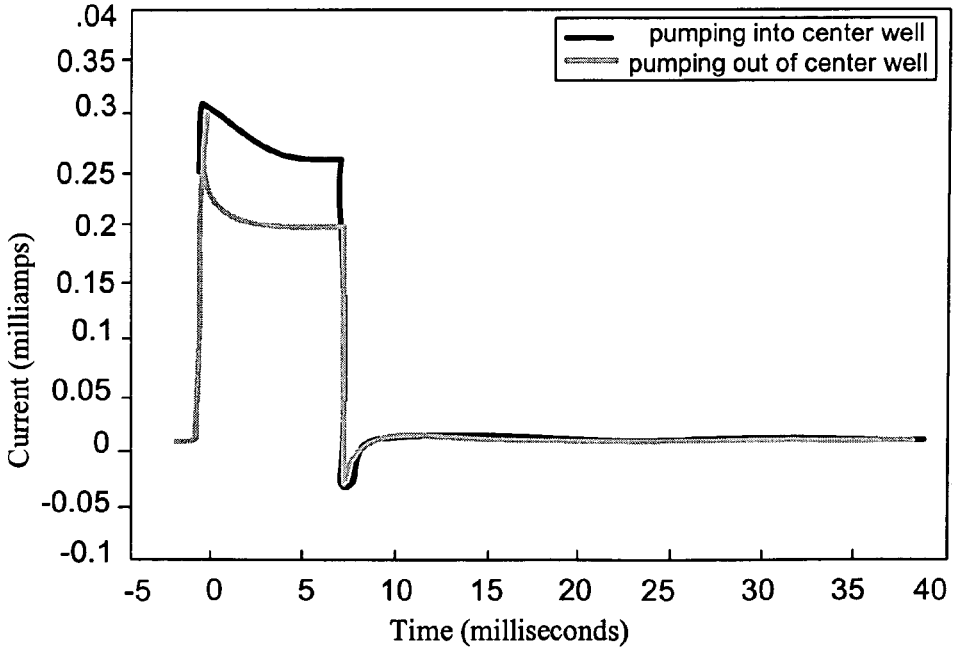

FIGS. 15A-15C shows the response of a 500 μm diameter actuator to a 25 Hz square wave input with a 20% duty cycle at 400 volts. This test was performed for both pumping into the center well (causing the membrane to deflect outward) and out of the center well (causing the membrane to deflect inward). Data was accumulated over 1,280 cycles to reduce noise. The response is qualitatively the same in both directions, although the magnitude of the membrane's outward deflection is larger than its inward deflection.

The measured frequency response and partial step response indicate that electroosmotic microactuators operated closed-loop could be used for applications requiring frequency response into the kilohertz range. The membrane appears to reach only a small fraction of its steady-state displacement in the first eight milliseconds after the voltage is turned on, however, suggesting that the open-loop bandwidth of the device is below 10 Hz. Finite element analysis indicates that the first resonant frequencies of both the 250 μm and the 500 μm membranes are above 100 kHz, so the microactuator response is not believed to be limited by the membrane dynamics. The relatively long timescale apparently required for the pressure generated by the electroosmotic pump to reach its maximum value has been observed in other studies of electroosmotic pumping and is not well understood at this time. Fixturing and tubing leading from the actuator to an external valve may be a source of volume capacitance in the microactuator; as currently designed, the microactuator can not be sealed off directly at the die level because of the need to purge electrolytic gas bubbles between experiments. Gas bubbles in the liquid may also be a source of volume capacitance. Gas bubbles arise not only from electrolysis at the electrodes, but also from degassing (e.g., due to increased temperature which reduces solubility) and, in extreme cases, boiling in or near the pump structure. This may be particularly prominent in zero-net-flow conditions that prevent convective transport of heat out of the pump structure.

Micromachined silicon electroosmotic pumps combine the reliability and effectiveness of electroosmotic pumping with the ease of fabrication and ready integration with other micromachined components afforded by silicon micromachining. Tests of the microactuator suggest that electroosmotic micropumps might be suitable for use in applications requiring actuator bandwidth as high as 1 kHz, although operation at lower frequencies may be required to produce a quasi-static microactuator response.

Figure 16:
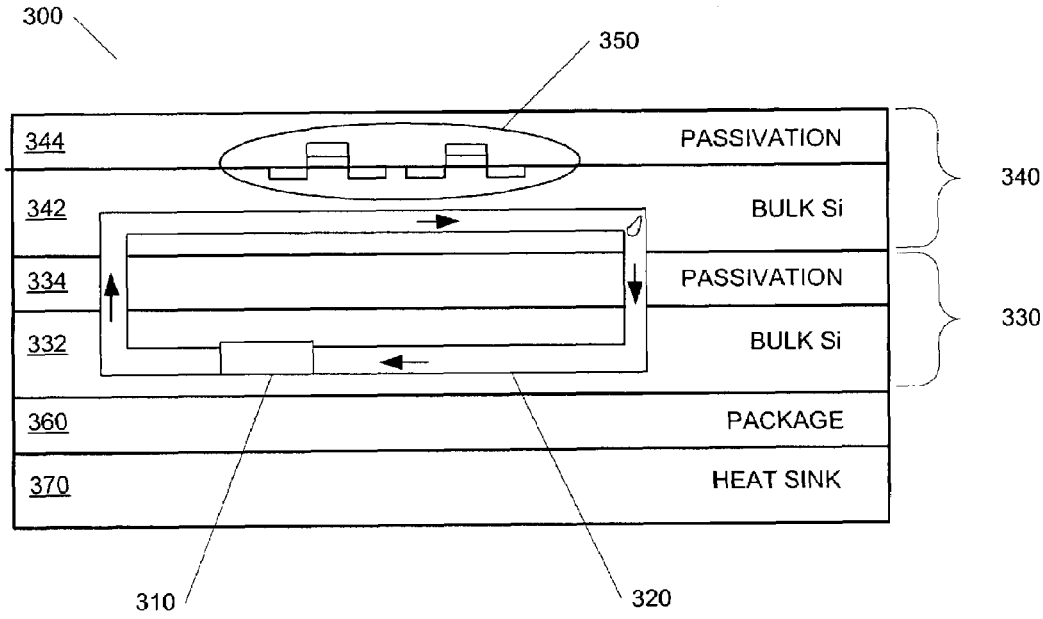
FIG. 16 illustrates a single phase forced convection cooling system that incorporates an integrated electroosmotic micropump for integrated circuit thermal management.

Another application of the present invention is in thermal management of integrated circuits (ICs). The silicon electroosmotic micropumps are fabricated in a CMOS-compatible process. They can be used to reduce the temperature of small, high-power density regions of microchips through single phase forced convective cooling. Systems-on-a-chip (SoC) and high performance ICs contain a mix of high and low power devices that are prone to developing hot spots during operation. FIG. 16 illustrates a single phase forced convection cooling system that incorporates an integrated electroosmotic micropump 310, thus avoiding the need for fluidic connections to the chip. Similar systems incorporating arrays of feedback-controlled silicon electroosmotic micropumps could provide on-demand forced convective cooling of spatially and temporally-varying hot spots.

FIG. 16 shows a cross-section of a two layer, three dimensional integrated circuit 300 with an electroosmotic micropump 310 integrated into a three-dimensional microchannel 320 for hot spot cooling. The arrows in the microchannel represent direction of fluid flow. Each chip layer 330, 340 includes bulk silicon 332, 342 and a passivation layer 334, 344, such as silicon nitride. The passivation layers 334, 344 can be coated with silicon oxide. A high power region 350 on the layer farthest from the heat sink 370, adjacent to chip carrier package 360 is cooled by single-phase forced convection. The micropump-driven forced-convective cooling supplements heat conduction from the high-power density region.

The corresponding structures, materials, acts, and equivalents of all means plus function elements in any claims below are intended to include any structure, material or acts for performing the functions in combination with other claim elements as specifically claimed.

Those skilled in the art will appreciate that many modifications to the exemplary embodiment of the present invention are possible without departing from the spirit and scope of the present invention. In addition, it is possible to use some of the features of the present invention without the corresponding use of the other features. Accordingly, the foregoing description of the exemplary embodiment is provided for the purpose of illustrating the principles of the present invention and not in imitation thereof since the scope of the present invention is defined solely by the appended claims.

What is claimed is:

1. An electroosmotic micropump that pumps a fluid having a liquid phase upon application of an electric field comprising:

a substrate;

an array of thin, closely-spaced, approximately planar, transversely aligned partitions formed in or on the substrate, among which electroosmotic flow (EOF) is generated, the partitions being approximately uniform in size, shape, and spacing and having an average height that is at least five times an average gap between partitions;

a plurality of electrodes positioned within enclosed manifolds on either side of the partition array for applying the electric field to the fluid during micropump operation; and an inlet and an outlet for a fluid to enter and exit the micropump.

2. The electroosmotic micropump of claim 1 further comprising an approximately conformal insulating layer coating on at least one surface of the partitions and manifolds to limit the flow of leakage current through the substrate during a pumping operation.

3. The electroosmotic micropump of claim 2 further comprising an approximately conformal additional layer which coats at least part of the insulating layers, the additional layer being interposed between the insulating layer and the fluid that is pumped.

4. The electroosmotic micropump of claim 1 wherein the substrate is a silicon substrate patterned using photolithography microfabrication.

5. The electroosmotic micropump of claim 1 wherein the partitions are formed by deep reactive ion enhanced etching.

6. The electroosmotic micropump of claim 1 wherein the average gaps between partitions are less than 5 μm wide.

7. The electroosmotic micropump of claim 1 wherein the electrodes comprise platinum wire.

8. The electroosmotic micropump of claim 1 wherein the electrodes are deposited onto at least one surface of the manifolds.

9. The electroosmotic micropump of claim 7 wherein electrodes are inserted directly into the manifolds through openings in the walls of the manifolds.

10. The electroosmotic micropump of claim 1 wherein the inlet port and the outlet port for the fluid connect a corresponding manifold and a corresponding edge of the partition array.

11. The electroosmotic micropump of claim 1 wherein the partition array and manifolds are enclosed by a structural element separate from the substrate.

12. The electroosmotic micropump of claim 2 wherein the insulating layer is fabricated from silicon nitride.

13. The electroosmotic micropump of claim 2 wherein the insulating layer is fabricated from a compound comprised of silicon and nitrogen elements.

14. The electroosmotic micropump of claim 3 wherein the additional layer is a silicon oxide compound.

15. The electroosmotic micropump of claim 3 wherein the additional layer is an oxidized polysilicon compound.

16. The electroosmotic micropump of claim 3 wherein the additional layer is a material selected based on an electrochemistry property of the selected material at the liquid-solid interface.

17. The electroosmotic micropump of claim 16 wherein the material selected for the additional layer is a dielectric material.

18. A method for manufacturing an electroosmotic micropump that pumps a fluid having a liquid phase upon application of an electric field, comprising the steps of:

selecting a substrate for the micropump;

forming an array of thin, closely-spaced, approximately planar, transversely aligned partitions in the substrate, the partitions being approximately uniform in size, shape, and spacing and having an average height that is at least five times an average gap between partitions;

forming an inlet and an outlet manifold on either side of the partition array;

forming a plurality of electrodes within the inlet and outlet manifolds for applying the electric field to the fluid during micropump operation; and forming inlet and outlet ports for the fluid to enter and exit the micropump.

19. The method for manufacturing an electroosmotic micropump of claim 18 further comprising coating at least one surface of the partitions and manifolds with an approximately conformal insulating layer to minimize the flow of leakage current through the substrate during a pumping operation.

20. The method for manufacturing an electroosmotic micropump of claim 19 further comprising coating the insulating layer with at least one approximately conformal additional layer, the additional layer being interposed between the insulating layer and the fluid that is pumped.

21. The method for manufacturing an electroosmotic micropump of claim 18 further comprising depositing electrodes onto a surface of each manifold.

22. The method for manufacturing an electroosmotic micropump of claim 18 further comprising forming the partition array and manifolds in the substrate and enclosing them with a structural element separate from the substrate.

23. The method for manufacturing an electroosmotic micropump of claim 19 wherein the step of coating the substrate with an insulating layer comprises depositing a silicon nitride film on the substrate through chemical vapor deposition at a low pressure.

24. An electroosmotic micropump that pumps fluid having a liquid phase upon application of an electric field comprising:

a substrate;

a multilevel planar structure formed in the substrate to generate electroosmotic pumping, the planar structure including a pumping channel comprising a pair of substantially flat surfaces that are substantially parallel to each other and separated by a distance that is determined based on a thickness of an electrical double layer associated with the pumped fluid, the multilevel planar structure further comprising an inlet reservoir and an outlet reservoir between which the pumping channel is disposed, each reservoir having a depth that is at least five times a pumping channel depth; and an electrode within each reservoir for the application of the electric field during micropump operation.

25. The electroosmotic micropump of claim 24 wherein the pumping channel depth is within two orders of magnitude of the thickness of the electrical double layer.

26. The electroosmotic micropump of claim 25 wherein the thickness of the electric double layer is on the order of the Debye length of the pumped fluid.

27. The electroosmotic micropump of claim 24 wherein the channel depth is selected to simultaneously optimize a flow capacity and a thermodynamic efficiency of the electroosmotic micropump.

28. The electroosmotic micropump of claim 24 further comprising a plurality of ribs on at least one of the flat surfaces of the pumping channel to improve the structural integrity of the electroosmotic micropump.

29. The electroosmotic micropump of claim 24 wherein an electroosmotic flow of the micropump is changed by application of a transverse electric field.

30. The electroosmotic micropump of claim 29 wherein the transverse electric field alters a zeta potential at a surface of the micropump to enhance, or reduce or reverse electroosmotic flow.

31. An apparatus for dispensing of fluids for drug dosing comprising:

a fluid reservoir and a dispensing device;

an electroosmotic micropump positioned between the reservoir and dispensing device to dispense fluid uniformly upon application of an electrical field, the electroosmotic micropump comprising:

a substrate;

an array of thin, closely-spaced, approximately planar, transversely aligned partitions formed in the substrate, the partitions being approximately uniform in size, shape, and spacing and having an average height that is at least five times an average gap between partitions;

a manifold disposed on each side of the partition array;

a plurality of electrodes located within the manifolds for applying the electrical field to the fluid during micropump operation; and an inlet port and an outlet port to enable the pumped fluid to enter and exit the micropump.

32. An apparatus for extraction of samples comprising:

a fluid reservoir and a sample extraction device;

an electroosmotic micropump positioned between the reservoir and sample extraction device to extract fluid upon application of an electrical field, the electroosmotic micropump comprising:

a substrate;

an array of thin, closely-spaced, approximately planar, transversely aligned partitions formed in the substrate, the partitions being approximately uniform in size, shape, and spacing and having an average height that is at least five times an average gap between partitions;

an inlet and outlet manifold disposed on either side of the partition array;

a plurality of electrodes located within the manifolds for applying the electric field to the fluid during micropump operation; and an inlet port and an outlet port to enable the pumped fluid to enter and exit the micropump.

33. The electroosmotic micropump of claim 1 wherein the pressure differential is at least 1 kPa.

34. The electroosmotic micropump of claim 1 wherein an average height of the larger of the two cross sectional dimensions of the openings between the partitions is at least 50 μm.

35. The electroosmotic micropump of claim 1 wherein a width of each planar partition is less than 20 μm.

36. The electroosmotic micropump of claim 1 wherein the substrate is a noninsulating material.

37. The electroosmotic micropump of claim 11 wherein the partition array and manifolds are enclosed by a glass plate bonded to the substrate.

* * * * *